US007559676B2

(12) United States Patent
Rasmussen et al.

(10) Patent No.: US 7,559,676 B2
(45) Date of Patent: Jul. 14, 2009

(54) LIGHT SOURCE MODULE

(75) Inventors: Niels Jorgen Rasmussen, Egaa (DK); Mads Glavind, Hobro (DK)

(73) Assignee: Martin Professional A/S, Aarhus N (DK)

( * ) Notice: Subject to any disclaimer, the term of this patent is extended or adjusted under 35 U.S.C. 154(b) by 95 days.

(21) Appl. No.: 10/599,582

(22) PCT Filed: Apr. 1, 2005

(86) PCT No.: PCT/DK2005/000227

§ 371 (c)(1),
(2), (4) Date: Apr. 17, 2007

(87) PCT Pub. No.: WO2005/095853

PCT Pub. Date: Oct. 13, 2005

(65) Prior Publication Data

US 2008/0089066 A1 Apr. 17, 2008

(30) Foreign Application Priority Data

Apr. 2, 2004 (DK) ..... 2004 00541

(51) Int. Cl.
*F21V 29/00* (2006.01)

(52) U.S. Cl. ..... 362/264; 362/294; 362/345; 362/373

(58) Field of Classification Search ..... 362/264, 362/218, 345, 373
See application file for complete search history.

(56) References Cited

U.S. PATENT DOCUMENTS 3,689,761 A 9/1972 Rosen et al.
3,840,734 A * 10/1974 Oram ..... 362/267
4,780,799 A 10/1988 Groh
4,985,815 A * 1/1991 Endo ..... 362/294

(Continued)

FOREIGN PATENT DOCUMENTS

DE 2259795 A1 6/1974

(Continued)

*Primary Examiner*—Ali Alavi
*Assistant Examiner*—Evan Dzierzynski
(74) *Attorney, Agent, or Firm*—David S. Safran; Roberts Molotkowski Safran & Cole, P.C.

(57) ABSTRACT

The present invention relates to a light source module comprising a light source, which light source module comprises cooling means for cooling the light source base, which light source module further comprises a dechroic reflector, where at least one heat sink surrounds the dechroic reflector. The object of the present invention is to reduce the temperature at the lamp base to increase the lifetime of a lamp. This can be achieved by a light source module that comprises at least a first heat sink, which first heat sink comprises a number of dishes, which dishes are formed to achieve air gabs there between, which dishes comprises at least one opening for the dechroic reflector, which dishes are placed radially around the dechroic reflector, which air gabs between the dishes are directed mostly perpendicularly to a centre axis of the light source module. Hereby, it is achieved that most of the infrared light, which is radiated in the direction of the dechroic reflector is absorbed in the dishes of the heat sink, and because the direction of the dishes is perpendicular to the main axis of the lamp module, the dishes conduct the heat radially towards the outer surface of the dishes.

10 Claims, 5 Drawing Sheets

U.S. PATENT DOCUMENTS

| | | | | |
|---|---|---|---|---|
| 5,515,254 | A | 5/1996 | Smith et al. | |
| 6,179,448 | B1 | 1/2001 | Johnson et al. | |
| 6,527,417 | B2 * | 3/2003 | Basey | 362/264 |
| 6,817,737 | B2 | 11/2004 | Romano et al. | |
| 2003/0086271 | A1 * | 5/2003 | Masuoka et al. | 362/345 |
| 2005/0122724 | A1 * | 6/2005 | Hirata et al. | 362/345 |

FOREIGN PATENT DOCUMENTS

| | | | |
|---|---|---|---|
| DE | 8620537 | U1 | 11/1986 |
| EP | 0846973 | A2 | 6/1998 |
| WO | 01 84043 | A1 | 11/2001 |

* cited by examiner

LIGHT SOURCE MODULE

BACKGROUND OF THE INVENTION

1. Field of the Invention

The present invention relates to a light source module comprising a light source, which light source is connected by a light source base, which light source module comprises cooling means for cooling the light source base, which light source module further comprises a dichroic reflector, where at least one heat sink surrounds the dichroic reflector.

2. Description of Related Art

Reducing the pinch temperature of a light source base at least with lamps having a filament is very important. The filament is connected by electric conductive means through the lamp closure and through the lamp base. Increasing temperature leads to an oxidation and corrosion of the electric conductors. This leads to a reduction of the lifetime of the lamp. Therefore, the temperature at the pitch must typically be reduced to a temperature below 450-500 degrees C.

U.S. Pat. No. 5,626,416 describes a lamp module apparatus comprising a reflector where a fan generates an air stream. The air stream surrounds a lamp base before the air stream splits up and continues into a space between an inner reflector and the lamp where another part of the air stream flows between the inner and an outer reflector. Infrared light generated by the lamp passes through the inner reflector towards the outer reflector where infrared light is partly absorbed and partly reflected.

A part of the infrared light that is absorbed in the outer reflector is radiated again at lower frequencies and partly towards the lamp base. Hereby, the lamp base might be heated to a temperature which is so high that it reduces the lifetime of the lamp.

U.S. Pat. No. 5,515,245 describes a light source housing which contains a light source where heat removal is provided by cooling fins and a heat filter supported in the light path, and where a portion of the light is reflected towards the cooling fins.

The cooling fins surround the reflector, but infrared light passes through the reflector, and is absorbed in the cooling fins. At least some of the cooling fins conduct the absorbed heat towards the lamp base, which leads to an increase of the temperature in the lamp base. This can lead to a reduced lifetime of the lamp.

U.S. Pat. No. 6,817,737 B2 describes a light projector which includes an elliptical reflector, a first spherical retro-reflector, the first retro-reflector having an first aperture formed therein, the first aperture having a first diameter and a first center-point, a second spherical retro-reflector located between the elliptical reflector and the first retro-reflector, the second retro-reflector having a second aperture formed therein, the second aperture having a second diameter and a second center-point, the second diameter smaller than the first diameter, the first and second center-points lying along a common axis, and a light source, the light source located at a foci of the elliptical reflector, the light source lying along the common axis, the elliptical reflector reflecting light emitted by the light source, the reflected light passing through the first and second apertures, the first and second retro-reflectors being positioned so as to reflect light emitted by the light source back towards the light source. Also provided is a light projector that includes a light source projecting a beam of light; and an optical element movable between a first position in which the beam of light does not impinge upon the optical element, a second position in which substantially all of the beam of light impinges upon the optical element, and a plurality of intermediate positions in which a portion of the beam of light impinges upon the optical element, wherein the optical element is comprised of a plurality of radially sectioned sub-elements.

This patent application describes cooling fins, which cooling fins are connected mechanical towards the reflector, and which cooling fins surrounds the reflector. No air gap is present between the reflector and the cooling fins. Thereby no airflow is possible between the reflector and the cooling fins. Only limited convection air-cooling takes place between the dishes.

SUMMARY OF THE INVENTION

The object of the present invention is to reduce the temperature at the lamp base to increase the lifetime of a lamp. A further object is to isolate generated heat in a limited area and conduct the heat away from that area towards the outside of the lamp module.

This can be achieved by a light source module that comprises at least a first heat sink, which first heat sink comprises a number of dishes, which dishes are formed to achieve air gaps there between, which dishes comprises at least one opening for the dichroic reflector, which dishes are placed radially around the dichroic reflector, which air gaps between the dishes are directed mostly perpendicularly to a centre axis of the light source module where the light source module can comprise a further air gap between the dichroic reflector and the dish formed heat sink where the said air gap between the dichroic reflector and the dish formed heat sink is open towards the air gaps between the dishes.

Hereby, it is achieved that most of the infrared light, which is radiated in the direction of the dichroic reflector is absorbed in the dishes of the heat sink, and because the direction of the dishes is perpendicular to the main axis of the lamp module, the dishes conduct the heat radially towards the outer surface of the dishes. Hereby, it might be achieved that the temperature at the surfaces at the dishes which absorb the infrared light are kept at a temperature where only a limited re-radiation of infrared light takes place back in a direction towards the lamp and the lamp base. By removing the heat effectively from the area around the dichroic reflector, only a very limited heating effect occurs at the lamp base and the temperature at the lamp base might be reduced to a temperature level below the maximum temperature defined by the lamp supplier. Only by reducing the temperature to a level below the specified temperature, the supplier can guarantee the lifetime of the lamp and by reducing the temperature to a level far below the specified maximum value, the lifetime of the lamp might be extended to a period, which is much longer than defined in the specification for the lamp. Further it is achieved that circulating air is allowed to flow between the dichroic reflector and the dish-shaped heat sink. Because of the relatively high temperature at the inner surface of the dishes, an airflow is generated simply by convection. Also, between the dishes, the increasing temperature might generate an airflow, which leads to a reduced temperature around the lamp, and a temperature reduction is also achieved in the dish-shaped heat sink.

The cooling means for the light source base might comprise a second heat sink, which heat sink is cooled by air convection. Hereby, a further reduction of temperature at the light base is achieved. Even if there is sufficient capacity of the heat sink surrounding the dichroic reflector, heat will be transmitted through the lamp terminal into the lamp base, which leads to an increasing temperature, and there is a cooling demand especially if high power lamps are used.

The cooling means for the base might comprise means for generating a forced air-flow around the light source base. Hereby, it is achieved that the forced air around the lamp socked secures the cooling effect independent of the direction of the lamp.

The light source base can be placed in a housing, which housing comprises an inlet for forced air and an outlet connected towards the air gab between the dichroic reflector and the dish-shaped heat sink. Hereby, it might be achieved that the pressure in the housing because of a constant flow through the inlet is at a higher level than the pressure that surrounds the light source module, and in this way, it is achieved that an airflow from the lamp housing towards the opening between the dichroic reflector and the dish-shaped heat sink will always be secured. This assures that a temperature at the light source module will be reduced at the lamp base even in a situation where the light source module points downwards where the normal heat conversion would be from the heat sink module and towards the lamp base. This is prevented by using forced air-cooling.

The light source module comprises at least one heat filter in the light path, which heat filter reflects infrared light towards the heat sink. Hereby, it is achieved that the light beam that is generated from the light source module has a reduced content of infrared light, and in this way, further components placed in the light source are partly protected against being heated by infrared radiation. This infrared radiation is instead reflected towards the dish-shaped heat sink which dish-shaped heat sink ends just under the heat filter for assuring that all reflected infrared light is reflected towards the dish-shaped heat sink. The heat filter might be in two parts combined at a centre point just above a lamp and placed in an angle assuring that reflected infrared light is reflected in a direction towards the upper part of the dish-shaped heat sink. By placing the heat filter with an angle towards the main direction of the light beam, the infrared light is directed away from the lamp and from the lamp base. Hereby, the temperature in the lamp is not increased by the infrared radiation, and, especially, the lamp base is easy to keep at a reduced temperature level.

The front and rear surface of the dish-shaped heat sink might be isolated towards other light source components. Hereby, it is achieved that heat conduction from the light source module is reduced, and the temperature increase in components connected to the light source module is prevented from being heated.

The air gap between the dishes forming the heat sink comprises a light trap for collecting infrared radiation. By using a light trap, all the light, which is radiated in the direction between the dish-shaped elements, hits the light trap, and the light trap as such is heated where the light trap components are heat-conductive connected to the dish-shaped elements. As an alternative the light trap could be formed by one or more protrusions in the dish-shaped elements.

The housing that surrounds the light source base can comprise at least one motor for adjusting the light source position. Hereby, it is achieved that a motor for adjusting the lamp position could be placed in the lamp base housing because the temperature is at a level where the motor could survive. The adjustment of the lamp is normally a mechanical operation using a tool at the backside of the housing. By allowing this adjustment by a motor, which motor could be a step motor placed inside the base housing, an external signal would be able to adjust the lamp position.

The light source base can be adjustable in the X, Y and Z direction by step motors connected to internal or external control means. Hereby, it is achieved that the lamp position is adjustable in all positions by means of step motors. By using external control means for the step motors, it is possible for example at a stage to adjust the lamp position in all directions based on the actual spot indicated for example at the stage. This indication of the spot could be made by camera means so adjustment could take place automatically.

This patent application also concerns a method for cooling a light source module, which light source module comprises a light source and a light source base which light source is surrounded by reflective means for reflecting visible light and passing infrared light towards a heat conducting heat sink for conducting absorbed heat from a light source towards the surroundings, where the heat sink is conducting the heat mostly into radial direction towards the outside of the light source module by a dish formed heat sink, where the dishes are directed mostly perpendicular to the centre axis of the light source module, where the light source module comprises a further air gab between the dichroic reflector and the dish formed heat sink where the said air gab between the dichroic reflector and the dish formed heat sink is open for air flow towards the air gabs between the dishes.

Hereby is achieved a very effective lamp cooling where the influence of the infra red light is reduced and where convection cooling of the heat sink is possible. Herby a lamp can be cooled only by convection or the power consumption cooling means are reduced.

In the following, the invention will be described with reference to drawings, where

DETAILED DESCRIPTION OF THE INVENTION

Figure 1:
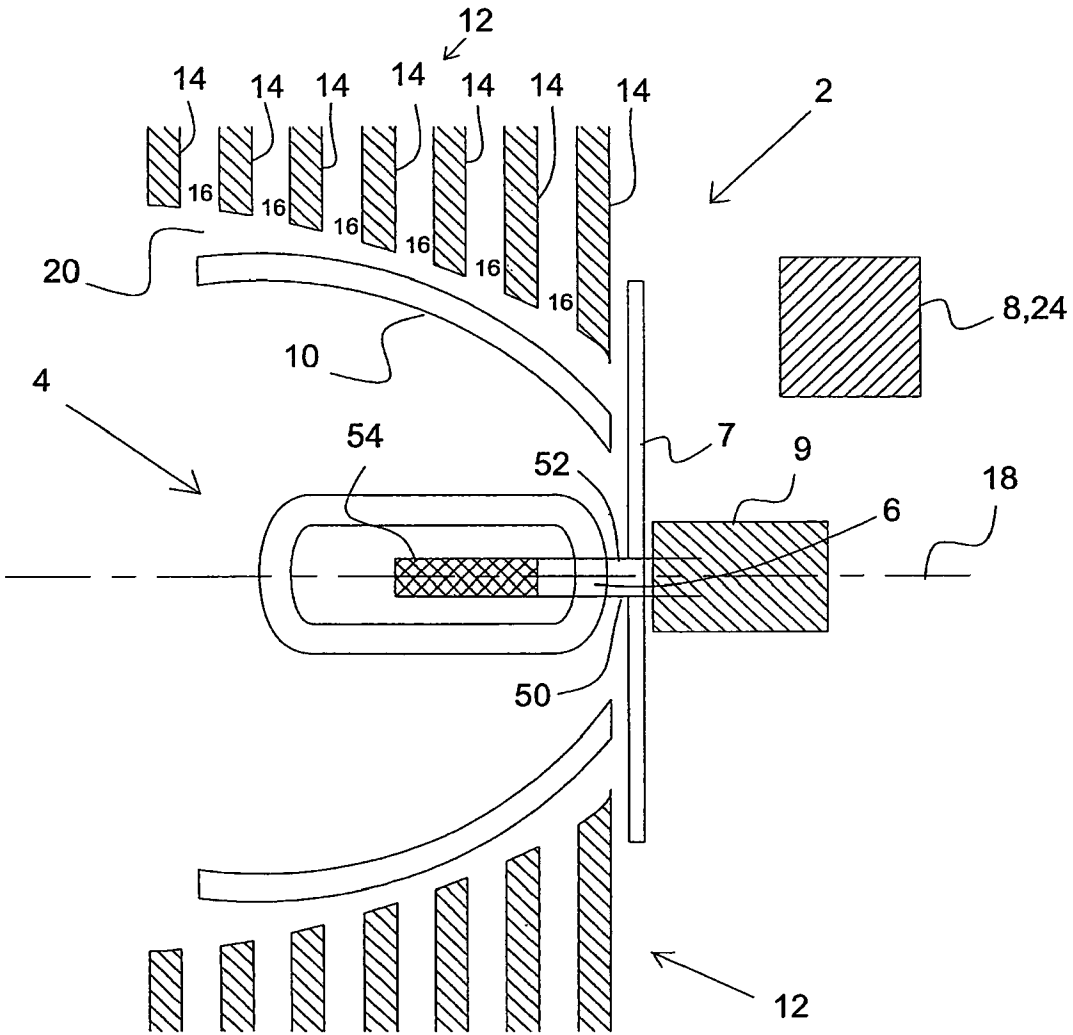
FIG. 1 shows a sectional view of a first possible embodiment of a light source module.

FIG. 1 shows a light source module 2 comprising a light source 4 connected to a light source base 6 where a reflector 7 is placed between the light source 4 and the light source base 6. Cooling means 8 for cooling the light source base 6 is shown which could be in form of means 24 for generating forced air, or a kind of passive means could be used. A lamp socket 9 is connected to the lamp base 6. A dichroic reflector 10 partly surrounds the light source 4 where a heat sink 12 is shown outside the reflector 10. The heat sink 12 is formed of a number of dishes 14 between which dishes 14, air gabs 16 exist. The dishes 14 and also the air gaps 16 are orientated perpendicularly to the centre axis 18 of the light source 2. Between the dishes 14 and the dichroic reflector 10, an gap 20 is shown.

In operation, the light source module 2 will operate in that the light source 4 generates light which light contains visible light but also have a great amount of infrared light. The dichroic reflector 10 reflects most of the visible light and leads a great part of the infrared light through. The infrared light is, therefore, absorbed by the heat sink 12 because the infrared light which passes through the reflector 10 heats the dishes 14 where most of the infrared light is absorbed. A further reflector 7 reflects visible light as well as infrared light back towards the light generating means 4 or the heat sink 12. In this way, the light source base 6 is prevented from being heated up by the radiation generated by the light source 4. The dishes 14 of the heat sink 12 are heated by the absorbed infrared light, and the dishes heat the air there between so the convectional flow of air will start in the air gaps 16 between the dishes 14. This air flow will also start a circulation of air in the air gap 20 between the dichroic reflector 10 and the dishes 14. Also around the reflector 7, an air flow will start probably because the convectional air flow through the air gaps 16 will generate a lower pressure around the light source 4 so air will be forced around the reflector 7 towards the light source 4. This assures a constant air flow towards and around the light source base 6 which is then kept at a relatively low temperature which will reduce the oxidation of the electrical terminals 50, 52. If a high temperature occurs at the terminals 50, 52, an oxidation will take place along the terminals 50, 52 through the glass bulb, and corrosion will start and reduce the cross section of the connectors. The corrosion might generate a small opening towards the filament 54 inside the glass bulb. As soon as oxygen has access to the inside of the bulb, a light source will be destroyed. Another possible destruction is simply that the corrosion reduces the cross-sectional of the terminal so that the electrical resistance increases, and the terminal is burned away which is also destructive to the light source.

Figure 2:
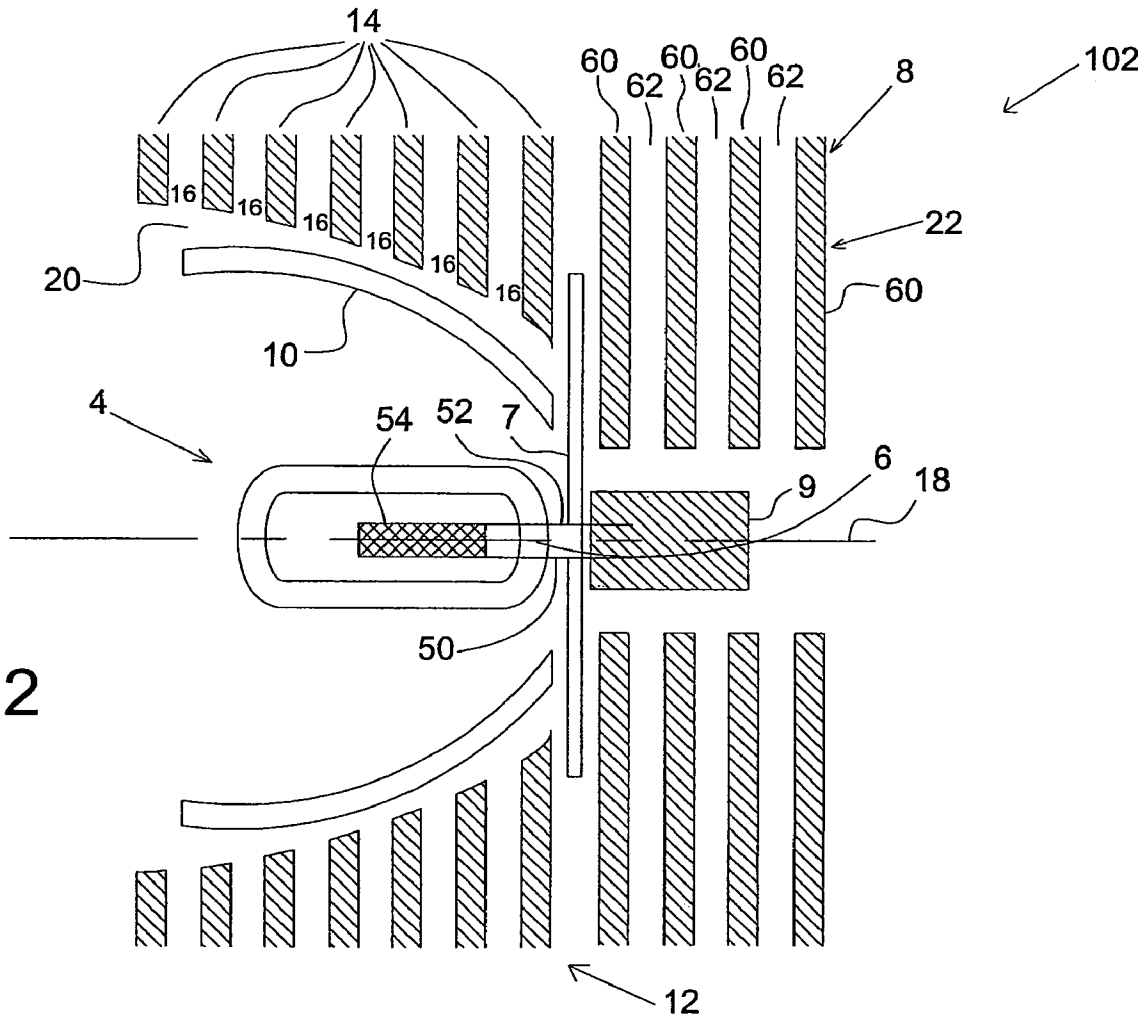
FIG. 2 shows a sectional view of a second possible embodiment of the invention.

FIG. 2 shows the same elements with the same reference numbers as used in FIG. 1 with the difference that cooling means 8 is formed by a second heat sink 22 which heat sink comprises dishes 60 where air gabs 62 are formed between these dishes.

The functions of the invention shown in FIG. 2 are mostly like the one described in FIG. 1, and it only differs in the use of the heat sink 22. The light source base 6 will in all circumstances be heated to a certain extent because the terminals 50, 52 are heat conductive. Also electrical resistance might occur in these terminals, and the way the terminals are connected to the lamp socket 9 might result in a small electrical resistance which leads to heating. Heat will be radiated from the light source base 6 towards the dishes 60, and an air flow will be generated in the air gaps 62 between the dishes 60. This can lead to an air flow around the light source base 6 which in this way is cooled to a temperature below the specified maximum temperature for the light source base which will increase the lifetime of the light source 4.

Figure 3:
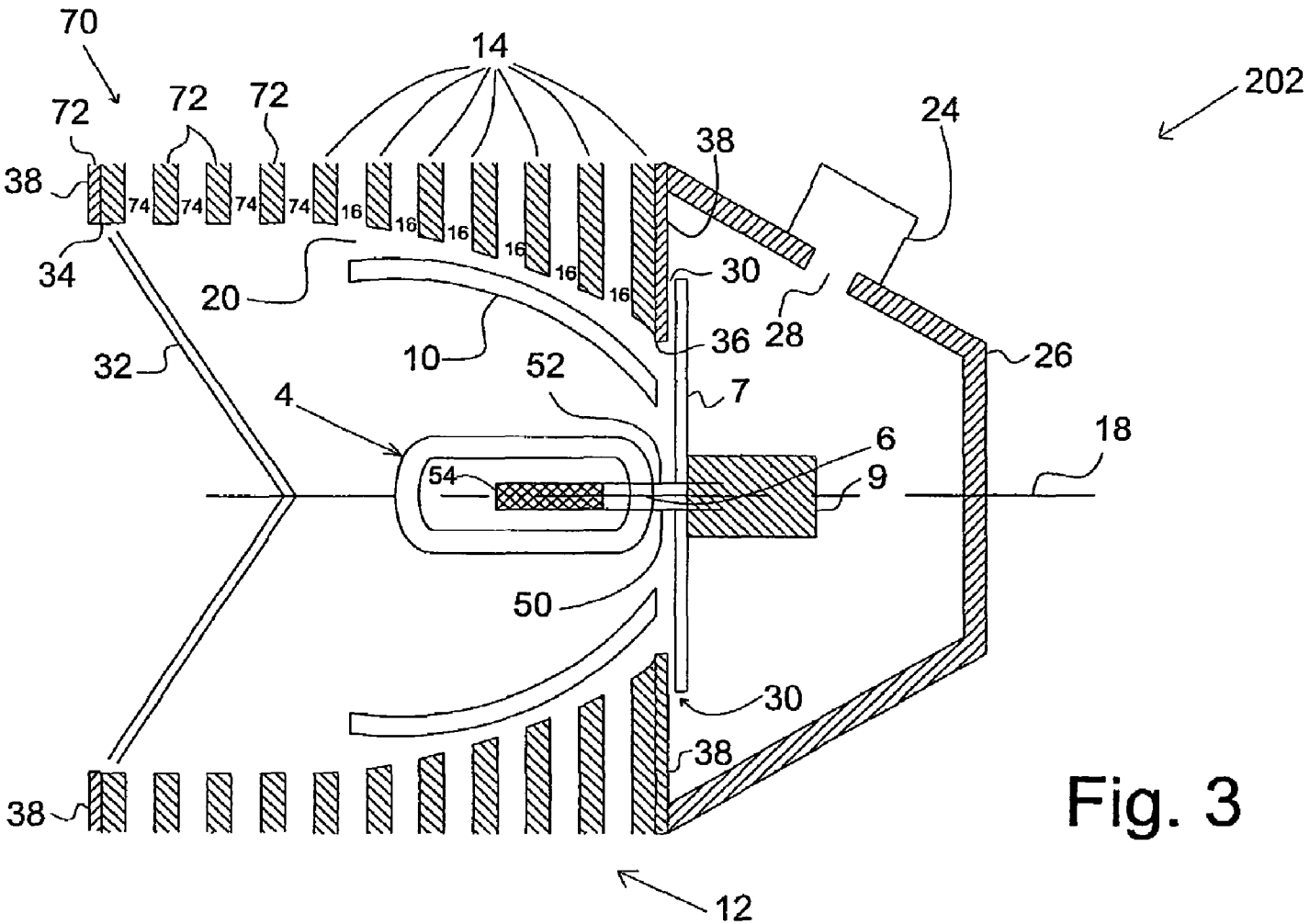
FIG. 3 shows a third sectional view of the invention according to a third embodiment of the invention.

FIG. 3 shows a third embodiment of the invention 202, which differs from FIG. 1 and FIG. 2 in that a housing 26 surrounds the light source base 6. Connected to the housing 26, means 24 for generating forced air is shown which means 24 could be in form of a small blowing unit which through an opening 28 in the housing 26 blows air towards the light source base 6. This also leads to an increasing pressure in the light source housing 26. A further difference to FIG. 1 and FIG. 2 is that a reflective heat filter 32 is shown in front of the dichroic reflector 10. This heat filter 32 is in two parts having an angle towards the centre axis 18 of the light source module where a third heat sink 70 continues where the first heat sink 12 ends. The third heat sink 70 is formed of dishes 72, and between these dishes, air gaps 74 are formed.

The reflective heat filter 32 reflects most of the infrared light contained in the light beam generated by the light source 4 and reflected by the dichroic reflector 10. Infrared light is reflected from the reflective heat filter 32 towards the heat sink 70 and towards the heat sink 12. In this way, it can be achieved that a very limited content of infrared light exists in the light beam that is delivered from the light source module and most of the heat generated by the infrared light is conducted away from the light source 4 and the light source base 6. The reflective heat filter can comprise more three angel formed filters forming a high number of reflective surfaces. Hereby the reflected infrared light is directed towards most of the dish formed heat sink. Even a conical formed mirror could be used for reflecting the infrared light. This will give a uniform distribution of the reflected infrared light over the dish formed heat sink By assuring a higher pressure inside the housing 26, an air stream will be generated around the reflector 7 and into the air gap 20, by using the means 24 for generating forced air, the light source module could be used in every orientation without a critical increase of temperature in the light source base 6.

Figure 4:
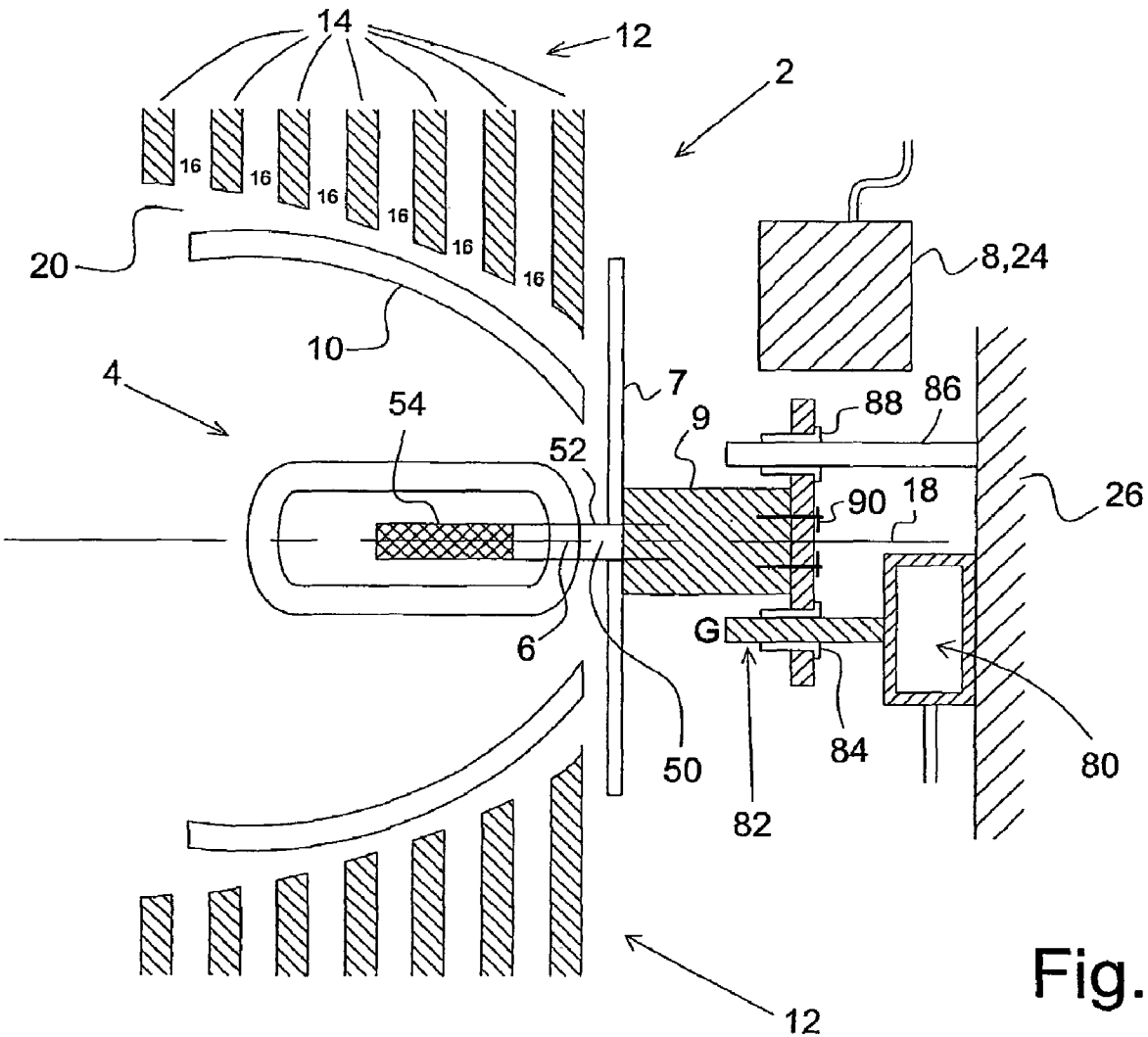
FIG. 4 shows a fourth sectional view of the invention comprising a motor for moving the lamp.

FIG. 4 shows the same elements as previous described with references to FIGS. 1-3 which are not repeated.

FIG. 4 shows a motor 80 connected to a spindle 82. The spindle cooperates with a screw 84 fixed to a fixture 90 where the lamp socket is fixed to the fixture. The motor is connected to the housing 26. Also connected to the housing, governing means 86 is shown which cooperates with sliding means 88 connected to the fixture 90.

Hereby, it is achieved that the position of the lamp can be controlled. An electronic control signal coming from a computer might control the movement of the motor. The effective cooling means around the lamp decreases the temperature inside the housing 26 to a level where a step motor can operate.

Figure 5:
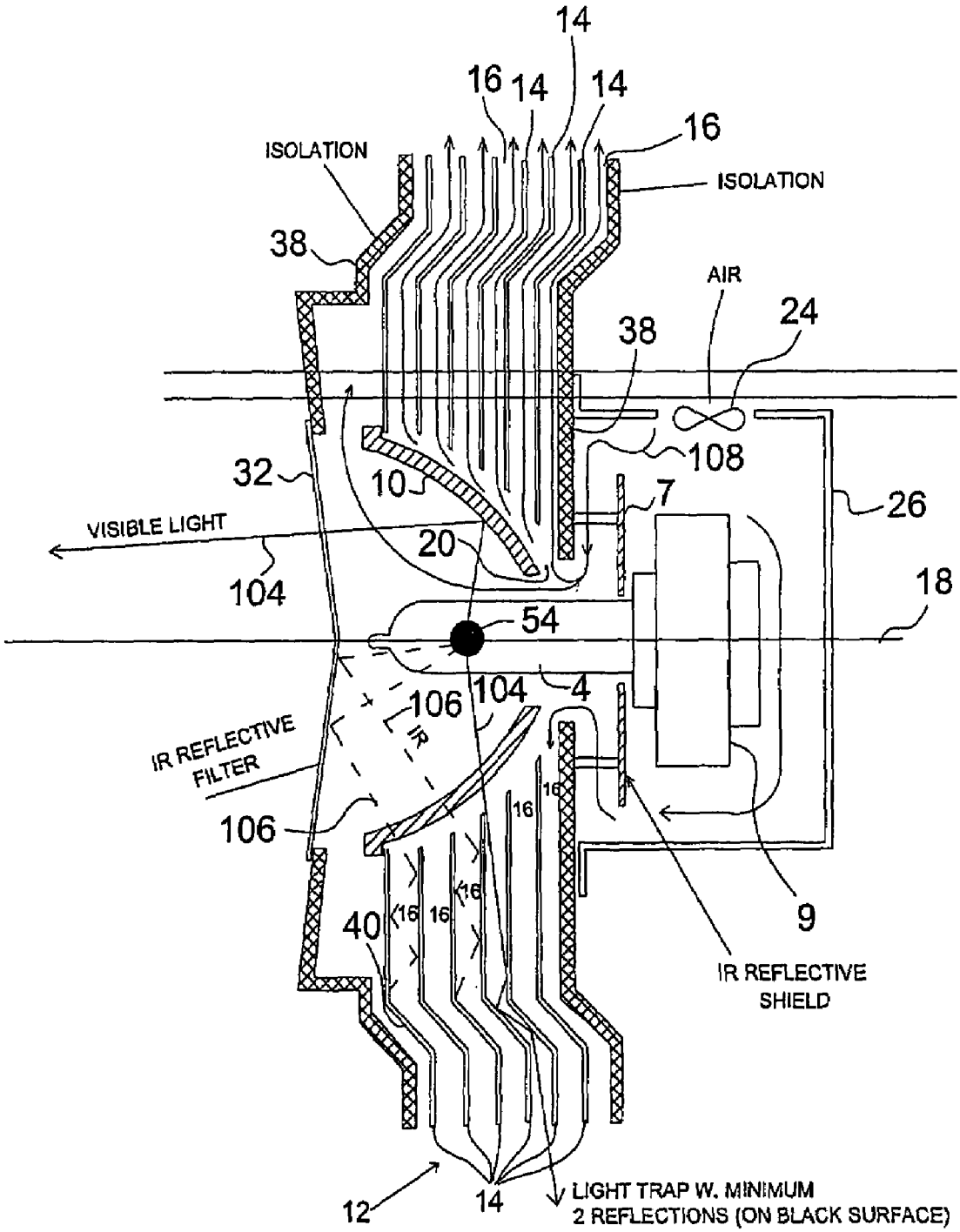
FIG. 5 shows an alternative embodiment of the invention.

FIG. 5 shows an alternative embodiment for the inventions comprising the same elements as previous described with reference to FIG. 14, which are not repeated in the following.

The FIG. 5 shows a light trap 40, which stops visible light 104 from the lamb, so that the open heat sink 12 remains relatively dark during operation. The FIG. 5 also shows arrows indicating visible light 104 and IR light 106. IR light 106 is reflected back from the reflector 22 towards the reflector 10, where the IR light 106 passes through and is absorbed at dishes 14. Further the FIG. 5 contains arrows indicating the airflow 108. The figure shows air flow 108 on both sides of the reflector 10, and from the backside of the reflector 10 the air flow 108 into the openings 15 between the dishes 14.

Herby is achieved a highly effective cooling of the lamb 4 and the lamp socket 9. This will increase the lifetime of the lamp.

The invention claimed is:

1. A light source module (2) comprising a light source (4), said light source is connected through a light source base (6), said light source module (2) comprises cooling means (8) for cooling the light source base (6), said light source module (2) further comprises a dichroic reflector (10), where at least one heat sink (12) surrounds the dichroic reflector (10), wherein the light source module (2) comprises at least a first heat sink (12), said first heat sink (12) comprises a number of dishes (14), said dishes (14) are formed to achieve air gaps (16) there between, said dishes (14) comprise at least one opening for the dichroic reflector (10), said dishes (14) are placed radially surrounding the dichroic reflector (10), said air gaps (16) between the dishes (14) are directed substantially perpendicularly to a centre axis (18) of the light source module (2), where the light source module comprises a further air gap (20) between the dichroic reflector (10) and the dishes of the heat sink (12) where the said air gap (20) between the dichroic reflector (10) and the dishes of the heat sink (12) is open towards the air gaps (16) between the dishes (14).

2. A light source module according to claim 1, wherein the cooling means for the light source base comprises a second heat sink (22), said heat sink (22) is cooled by air convection.

3. A light source module according to claim 1, wherein the cooling means (8) for the base comprises means (24) for generating a forced air flow around the light source base (6).

4. A light source module according to claim 3, wherein the light source base (6) is placed in a housing (26), said housing (26) comprises an inlet (28) for forced air and an outlet (30) connected towards the air gap (20) between the dichroic reflector (10) and the dish-shaped heat sink (12).

5. A light source module according to claim 1, wherein the light source module (2) comprises at least one heat filter (32) in the light path, said heat filter (32) reflect infrared light towards the heat sink (12).

6. A light source module according to claim 1, wherein the front (34) and rear surface (36) of the dish-shaped heat sink (12) are isolated by isolation means (38) towards other light source components.

7. A light source module according to claim 1, wherein the air gaps between the dishes forming the heat sink comprises a light trap (40) for collecting infrared radiation.

8. A light source module according to claim 1, wherein the housing (26) that surrounds the light source base (6) comprises at least one motor (42) for adjusting the position of the light source (4).

9. A light source module according to claim 8, wherein the light source base (6) is adjustable in the X, Y and Z direction by step motors (44, 46, 48) connected to internal or external control means.

10. Method for cooling a light source module that comprises a light source and a light source base which is surrounded by reflective means for reflecting visible light having a dichroic reflector and passing infrared light towards a heat conducting heat sink for conducting heat absorbed from the light source towards the surroundings, comprising the steps of:

providing the heat sink with dish-shaped elements that are directed substantially perpendicular to a center axis of the light source module and that are placed radially around the dichroic reflector, providing air gaps between the dish-shaped elements, the air gaps being directed substantially perpendicularly to the center axis of the light source module, providing an additional air gap between the dichroic reflector and the dish-shaped elements of the heat sink, the additional air gap being open for air flow towards the air gaps between the dish-shaped elements, placing the light source base in a housing that surrounds the light source base, directing air heated by the light source through an outlet in the housing toward the additional air gap and from the additional air gap towards the air gaps between the dish-shaped elements, and conducting the heat absorbed by the heat sink in a substantially radial direction towards the outside of the light source module using the dish-shaped elements of the heat sink.

* * * * *